US005269224A

United States Patent [19]

Gonzales et al.

[11] Patent Number: 5,269,224

[45] Date of Patent: Dec. 14, 1993

[54] CASELESS UTILIZED AMMUNITION CHARGE MODULE

[75] Inventors: Antonio Gonzales; Henry H. Raines, both of Tallahassee, Fla.

[73] Assignee: Olin Corporation, Cheshire, Conn.

[21] Appl. No.: 896,487

[22] Filed: Jun. 2, 1992

Related U.S. Application Data

[63] Continuation of Ser. No. 575,057, Aug. 30, 1990, abandoned.

[51] Int. Cl.[5] ..... C06B 45/00

[52] U.S. Cl. ..... 102/288; 102/285; 102/289; 102/290; 102/291; 102/292; 102/275.11; 102/275.6; 102/431; 102/432; 102/700; 149/97; 149/98; 149/111

[58] Field of Search ..... 102/285, 288, 289, 290, 102/291, 292, 275.11, 275.6, 431, 432, 433, 700; 149/97, 98, 111

[56] References Cited

U.S. PATENT DOCUMENTS

| | | | |
|---|---|---|---|
| 864,725 | 8/1907 | Davis | 102/282 |
| 1,329,503 | 2/1920 | Casey | 102/282 |
| 1,625,631 | 4/1927 | Spotswood et al. | 102/282 |
| 2,405,104 | 7/1946 | Mydans | 102/282 |
| 2,964,521 | 12/1960 | Coffee | 260/223 |
| 2,995,091 | 8/1961 | Haymes | 102/98 |
| 3,092,525 | 6/1963 | Cook | 149/2 |
| 3,191,535 | 6/1965 | Mulloy | 102/98 |
| 3,754,510 | 8/1973 | Marondel et al. | 102/101 |
| 3,771,460 | 11/1973 | Ayer | 102/97 |
| 3,779,820 | 12/1973 | Stevely et al. | 149/2 |
| 3,911,825 | 10/1975 | Gawlick et al. | 102/431 |
| 3,994,235 | 11/1976 | Politzer et al. | 102/101 |
| 4,092,189 | 5/1978 | Betts | 149/19.2 |
| 4,202,713 | 5/1990 | Ragon et al | 149/100 |
| 4,279,672 | 7/1981 | Leneveu et al. | 149/19.8 |
| 4,282,813 | 8/1981 | Sterbutzel | 102/431 |
| 4,354,884 | 10/1982 | Williams | 149/10 |
| 4,519,855 | 5/1985 | Lenevue et al. | 149/21 |
| 4,576,094 | 3/1986 | Meador | 102/202.12 |
| 4,702,167 | 10/1987 | Reinelt et al. | 102/282 |
| 4,754,704 | 7/1988 | Lübbers | 102/275.11 |
| 4,841,863 | 6/1989 | Bourgeois | 102/523 |
| 4,864,932 | 9/1989 | Reinelt et al. | 102/282 |
| 4,911,795 | 3/1990 | Olliff, Jr. | 204/4 |
| 4,922,823 | 5/1990 | Rahnenführer et al. | 102/288 |

*Primary Examiner*—Donald P. Walsh
*Assistant Examiner*—Chrisman D. Carroll
*Attorney, Agent, or Firm*—Bruce E. Burdick

[57] ABSTRACT

A unitary propellant charge module for use in separate ammunition comprises a combustible container having a generally hollow cylindrical shape, a generally cylindrical charge body of interconnected compacted spheroidal propellant grains disposed within the container, each of the grains having an uncompacted propellant grain diameter of at least 100 mils, and at least one generally tubular center core igniter body of interconnected compacted spheroidal propellant grains having an unrolled grain size between about 20 to less than 100 mils in diameter. The igniter body is disposed within a central bore extending along the longitudinal axis of the charge body.

27 Claims, 3 Drawing Sheets

CASELESS UTILIZED AMMUNITION CHARGE MODULE

This application is a continuation of application Ser. No. 07/575,057 filed Aug. 30, 1990, now abandoned.

BACKGROUND OF THE INVENTION

This invention relates generally to ammunition and more particularly to a unitary charge module for separate ammunition used in large caliber artillery.

Large caliber gun ammunition (such as is used on naval ships) does not normally have a single, unitary cartridge but instead typically includes two separate components: (a) a projectile and (b) one or more separate bags or containers of propellant. The projectile and the propellant containers are sequentially loaded into the breech of the gun either by hand or automatically. The effective range of the projectile can be selected by the choice of how many bags or containers of propellant are loaded into the gun.

Early separate propellant charge containers were typically bags of either silk or cotton which had pockets to contain the ignition charge at one end. Typical designs of such containers are described in U.S. Pat. Nos. 864,725; 1,329,503; 1,625,631; 2,405,104; and 3,771,460.

A more recent patent, U.S. Pat. No. 4,282,813 discloses a unitary propellant charge formed in a cylindrical shape having a central bore along its axis for propagating a primer flash. The charge contains a priming charge at one end and has an outer coating of a heat shrinkable polyester film such as mylar. This unitary charge is not designed for use where multiple charges are employed.

Current propellant charge containers are made today so that they are interchangeable in terms of orientation. That is, they are axially symmetrical and radially symmetrical about the longitudinal axis so that several can be loaded and they can be loaded in the dark without danger of incorrect front to back orientation. Typical of such charge containers are those disclosed in U.S. Pats. 4,702,167, 4,864,932, and 4,922,823.

U.S. Pat. Nos. 4,702,167 and 4,864,932 also disclose a unitary propellant charge having a cylindrical shape with a central bore therethrough. However, in these patents, the charge, composed of black powder, surrounds a tubular igniter or a stack of self centering rings made of extruded porous nitrocellulose or an admixture of nitrocellulose and a known primer charge such as boron/potassium nitrate powder. The main charge of black powder is contained in an annular envelope which uses the igniter as the inner wall. This arrangement permits stacking without alignment problems and allows variation of the total propellant quantity by loading multiple charges in a gun.

U.S. Pat. No. 4,922,823 discloses an igniter charge for a unitary propellant charge module such as is disclosed in the last described patents in which the igniter is made of a composite of an inner igniter tube and an outer support tube. Both tubes are made of extruded propellant powders and may be separately pressed in a mold to form the tubes. The igniter and support tubes are then adhesively bonded together. Alternatively the two tubes may be coextruded together. The igniter charge is then assembled into an annular main charge container.

One problem with such separate ammunition charge modules using conventional propellants such as black powder or nitrocellulose based extruded propellant formulations such as JA2 and M30 is the high sensitivity of these propellants to shock and their high flame temperatures. This combination results in a relatively high vulnerability of these propellants to the effects of shape charge attack. In addition, the high flame temperatures severely limits the potential rate of cannon fire and barrel life.

It is therefore an object of the present invention to provide an improved unitary charge module of separate ammunition.

It is another object of the present invention to provide a unitary propellant charge module that has improved resistivity to shock impulses.

It is another object of the invention to provide an improved unitary propellant charge to extend barrel life of the gun in which the charge is fired.

It is another object of the invention to provide a unitary charge module of compacted spherical propellant grains.

It is another object of the invention to provide a unitary propellant charge having a center core igniter of compacted spherical propellant grains.

It is another object of the invention to provide a unitary propellant charge of compacted spherical propellant requiring no separate combustible case enclosing the charge.

SUMMARY OF THE INVENTION

The present invention comprises a propellant charge module for use in separate ammunition which is primarily a solid body of compacted spheroidal or oblate spheroidal propellant grains pressed together so that the grains adhere to one another to form one solid porous body, each of said grains having an uncompacted propellant grain diameter of at least 100 mils. The uncompacted grain size is preferably within a range of between about 120 to about 160 mils. A preferred compacted spheroidal propellant for use in the main charge of the present invention is available from Olin Corporation under the trademark BALL POWDER®, number WC950.

The unitary charge module has a generally right circular cylindrical shape and has an open central axial bore through the module. This bore channels the conventional priming flash from the separate primer.

A solid compacted igniter charge having a tubular shape is disposed in the central bore. The igniter charge is an annular right circular cylinder also of compacted spherical propellant grains which lines the central bore through the charge module. However, in this case, each of the grains has an uncompacted grain diameter of between about 20 to about 100 mils in diameter and preferably between about 40 to about 70 mills in diameter. A suitable spherical propellant for the igniter is BALL POWDER® model No. WC 615, also available from Olin Corporation. However, the propellant actually used should be specifically tailored to the specific application on a case by case basis to optimize ignition. The igniter charge propagates the ignition flame front axially at a greater speed than the radial burn rate of the charge so that the entire charge burns symmetrically radially outwardly eliminating major pressure oscillations during ignition of the main propellant charge.

The above and other features and advantages of the invention will become more readily apparent from the following description it being understood that any feature described with reference to one embodiment of the invention can be used where possible with any other embodiment.

DETAILED DESCRIPTION OF THE INVENTION

Figure 2:
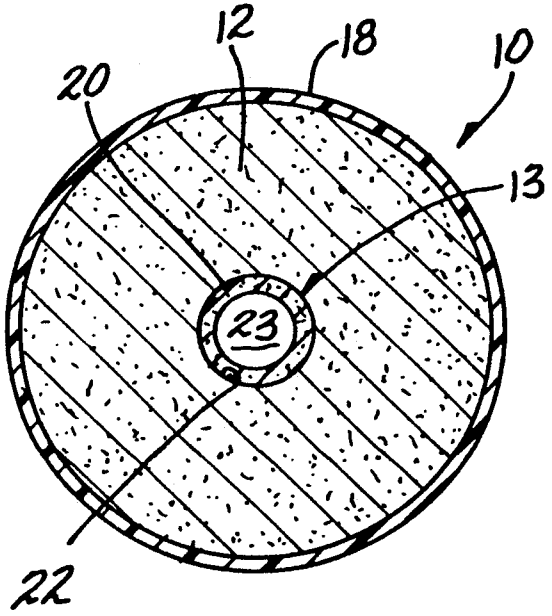
FIG. 2 is a sectional view of the module shown in FIG. 1 taken on the line 2—2.
Figure 1:
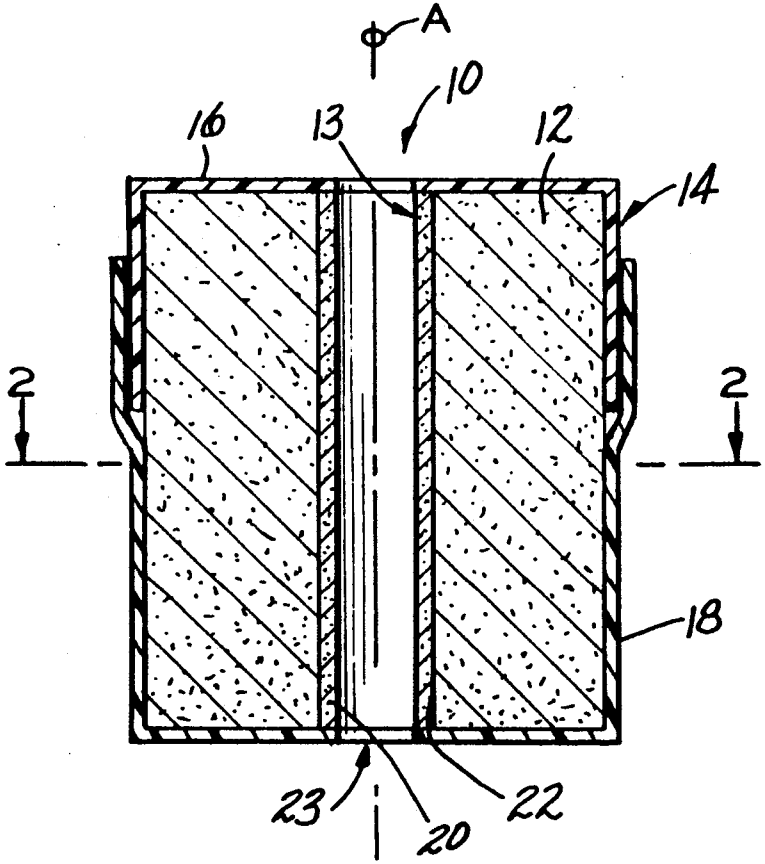
FIG. 1 is a sectional view through a first embodiment of the unitary charge module in accordance with the present invention.

"Spherical" and "spheroidal" as used herein also includes oblate spheroidal (i.e. with flattened ends like a partially inflated beach ball). As shown in FIGS. 1 and 2, a first embodiment of the unitary charge module 10 of the invention has a cylindrical annular main charge body 12 with a center core igniter 13 contained within a two piece combustible case 14 having a top member 16 and a bottom member 18 so shaped so that the top member slides into bottom member 18 to enclose the main charge body 12. The center core igniter 13 forms an inner wall lining a central bore 22 through the main charge 12.

The unitary charge module 10 in accordance with the invention is axially and radially symmetrical about its longitudinal axis A so that one or more of the modules may be inserted into the breech of a gun with either end first. This symmetry permits simple, fast handling procedures and eliminates the consequences of misorientation. This symmetry also simplifies multiple charge loading to vary the range of the projectile fired from the gun as well as increased firing rates and reduced barrel wear as will be subsequently described.

The main charge 12 is a compacted body of rolled or unrolled smokeless spheroidal propellant powder, preferably BALL POWDER® model No. WC950. The powder has an unrolled grain size of at least 100 mils in diameter and is preferably compacted after being softened on the grain surface by soaking the uncompacted grains in a solvent such as butyl acetate sufficient to make the surface of the grains tacky. The grains are then compacted to form the main charge body. The main charge 12 is thus a porous body made of interconnected spheroids of propellant. The interconnected grains may also be made by coating the propellant grains with a surface adhesive prior to compaction thus eliminating the need for a solvent.

The grains are preferably between about 120 and 160 mils in diameter. In particular, 150 mil grains are preferably compacted to form the unitary charge module intended to be used in the M199 cannon, a 155 mm howitzer.

The use of large spheroidal or oblate spheroidal propellant is critical to the performance of the unitary charge module in accordance with the invention. Spheroidal propellants such as BALL POWDER® propellant result in much lower gun gas temperatures than comparable conventional propellants such as JA2 and M31A1E1. For example, M31A1E1 powder, presently used in the 155 mm howitzer, has a flame temperature of about 2700° Kelvin. The BALL POWDER® propellant of the invention having a 150 mil grain size also has an average flame temperature of about 2700° Kelvin. However, the BALL POWDER® propellant has a burn rate deterrent outer layer. This deterrent layer results in much lower mean gun gas temperatures and lower chamber pressures. For example, the predicted mean gun gas temperature using compacted BALL POWDER® propellant is less than 2000° Kelvin. In contrast, M31AIEI propellant use yields temperatures well in excess of 2000° Kelvin, peaking at about 2600° Kelvin. These lower temperatures and pressures resulting from the use of BALL POWDER® propellant compacted into the unitary charge module of the invention are expected to translate into significant improvements in barrel life and permissible rates of fire.

The top and bottom container members 16 and 18 are formed from conventional combustible case materials such as cellulose fibers impregnated with nitrocellulose and a resin binder. The members may be overlapping as shown in FIG. 1 or may be butt joined. In the latter case they would by joined with a suitable combustible adhesive. These members provide moisture protection and abrasion protection during handling and field storage of the unitary charge module.

The center core igniter 13 is a tubular solid body 20 also formed of compressed spheroidal or oblate spheroidal propellant powder having an unrolled grain size of between about 20 to less than about 100 mils and more preferably between about 40 to about 70 mils. The tubular body 20 is thus a porous body made of interconnected spheroids of propellant. The propellant in the center core igniter 13 preferably is an undeterred spherical propellant so that the primer flash is propagated almost instantaneously along the igniter length. The tubular body 20 may be adhesively or frictionally fit within the bore 22 through the main charge 12. A central passage 23 through the center core igniter body 20 directs passage of the primer flame front (not shown) upon ignition. This passage may be clear or may be used to contain strands of ignition materials such as benite.

The solid igniter body 20 is formed in the same manner as the main charge body 12 by the addition of a solventless binder (adhesive) or a solvent such as butyl acetate to the uncompressed grains. In either case, the coated grains become tacky. They are then compressed to form the solid igniter body 20 and the excess solvent is removed.

The container members 16 and 18 are not structurally required for the unitary charge module in accordance with the invention. The main charge 12 is a solid body which is self supporting. The compressed BALL POWDER® propellant of the main charge 12 retains its granular character however, and, upon ignition, deflagrates as a loose powder.

Figure 4:
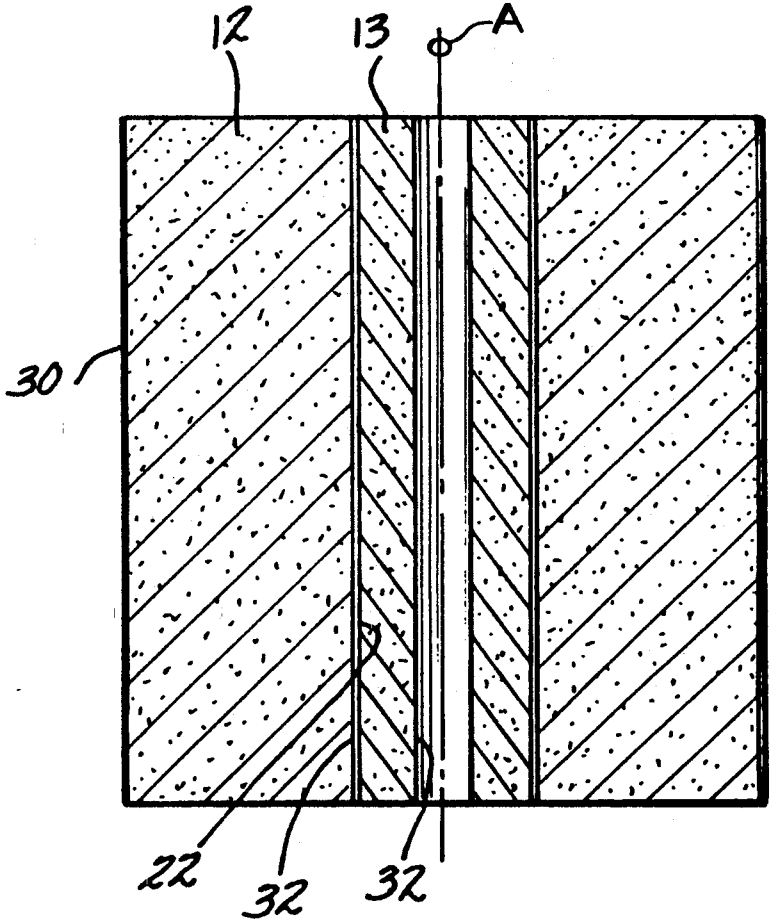
FIG. 4 is a side sectional view of a second embodiment of the unitary charge module in accordance with the present invention.

As shown in FIG. 4, a second embodiment of the unitary charge module of the invention may simply comprise a main charge 12 containing a center core igniter 13 without the casing 14. In this alternative embodiment, abrasion and moisture protection may be provided by a thin coating 30 of mylar, lacquer, rubber, a polyurethane system, or other combustible material applied after the compressed body is formed and the excess solvent removed. The coating, if applied as a liquid, dries to form a protective film on the exterior of the main charge.

A similar protective coating 32 may be applied to the inside and or outside surface of the center core igniter 13 prior to its installation into the bore 22 in the main charge 12. This coating 32 may also include burn rate modifiers to tailor the overall burn rate to a specific gun's requirements.

Figure 3:
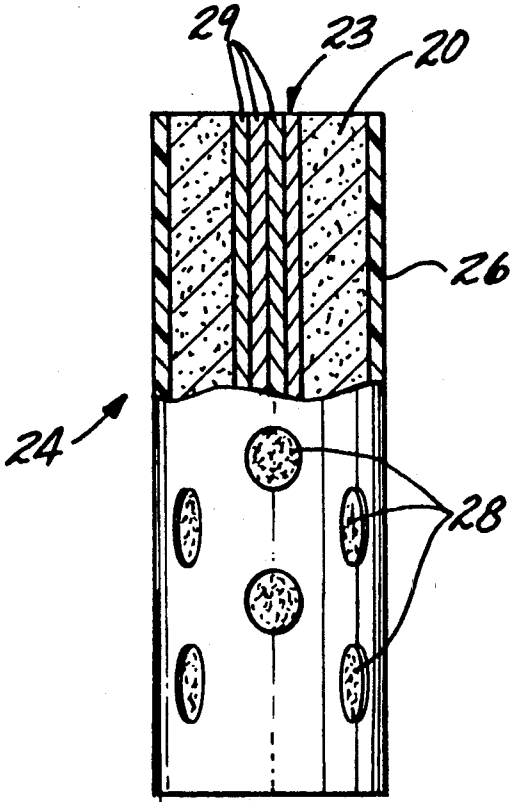
FIG. 3 is a side partial sectional view of an alternative embodiment of a center core igniter for use in the unitary charge module in accordance with the present invention.

An alternative embodiment of the center core igniter is illustrated in FIG. 3. In this embodiment the igniter 24 includes a sleeve 26 of combustible case material around the tubular body 20 of the igniter. The sleeve has a plurality of apertures 28 along its length to direct the ignition flame into the main charge. A plurality of benite strands 29 are centrally disposed in the central bore 23 through the tubular body 20.

The tubular body 20 of both the center core igniters 13 and 24 and the main charge 12 are formed by the same general process The rolled (oblate spheroidal) or unrolled (spheroidal) propellant grains are coated with a nitrocellulose solvent such as butyl acetate. Butyl acetate has been found to be the preferred solvent. However, other similar solvents may be used such as ethyl acetate or acetone.

The solvent diffuses into the surface of the grains. The grains can then be conditioned at a temperature of between about 35° to 50° Fahrenheit to prevent excessive solvent migration. The propellant grains are then reconditioned to about 70° F. and compressed in a mold to form the cylindrical shape of the main charge 12 or the center core igniter body 20. Finally, the excess solvent is then driven off.

Figure 5:
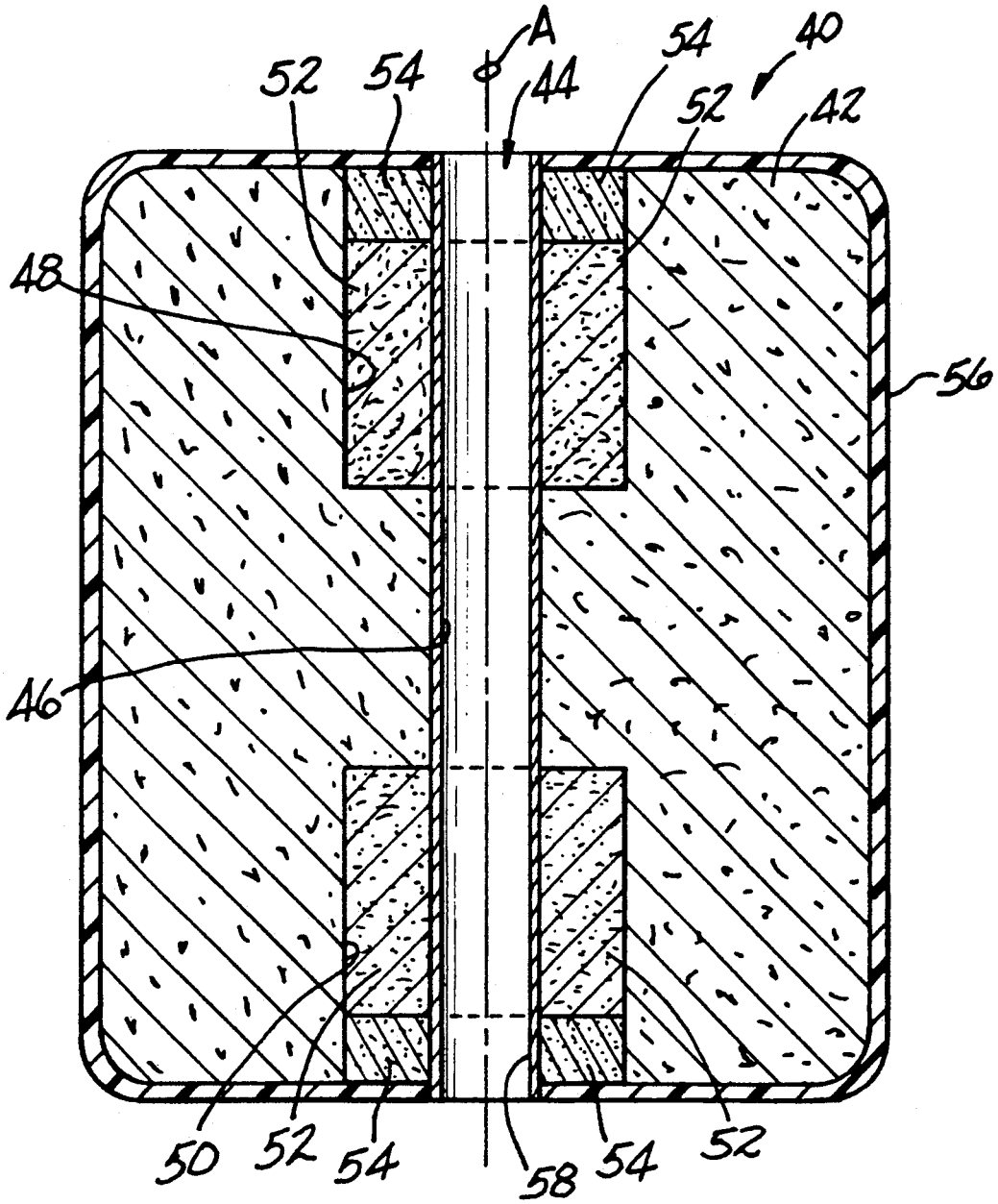
FIG. 5 is a side sectional view of a third alternative embodiment of the unitary charge module in accordance with the invention.

A third embodiment of the unitary charge module in accordance with the invention is shown in FIG. 5. The module 40 is a right circular cylindrical main charge body 42 made of compacted BALL POWDER® propellant. The body 42 has a central through bore 44 along its longitudinal axis. This through bore 44 has a constricted central portion 46 between two opposite end portions 48 and 50. The end portions 48 and 50 each have a greater radius than the central portion 46 to accomodate an igniter support tube 52 and an igniter ring 54 at the outer ends of the bore 44. The igniter support tubes 52 and the igniter rings 54 have outer diameters sized to snugly fit into the end portions 48 and 50 of the through bore 44 and have inner diameters preferably matching the diameter of the constricted central portion 46 of the main charge body 42.

The main charge body 42 is encased preferably by a moisture proof outer composite casing 56 made of combustible fibers. The central bore 44 is similarly lined with an inner channel casing 58. The casing 56 and liner 58 provide moisture and abrasion protection during module handling. The casing and liner may also be applied as a liquid or shrink-wrap coating and thus may be very thin and light weight.

The main charge is formed as above described in the previous embodiments and also preferably utilizes BALL POWDER® propellant grains having an unrolled grain size of about 150 mils.

The igniter support tubes 52 are made of compacted BALL POWDER® propellant having a grain size between about 40 and 70 mils and are also formed as previously described. The igniter support tubes thus extend only partially along the through bore 44. This arrangement provides an alternative way to vary the ignition rate of the propellant in the main charge by varying the surface area of the main charge directly exposed to the ignition flame front. Thus the length of the ignition support tubes can be chosen so as to optimize the ignition geometry within the module.

The ignition rings 54 at each end of the central bore 44 are preferably formed of compressed fine grain undeterred spheroidal or oblate spheroidal propellant or black powder so as to couple the initial primer flash rapidly into the igniter support tube. This arrangement increases the module to module ignition sensitivity.

Although the invention has been shown and described with reference to three preferred embodiments, other variations and modifications are contemplated as being within the scope of the invention. Accordingly it is intended to embrace all such variations and modifications as defined by the scope of the appended claims. All patents, patent applications and other references referred to herein are hereby incorporated by reference in their entirety.

What is claimed is:

1. A unitary propellant charge module adapted for use as a main charge body in large caliber guns requiring separate ammunition to provide improved barrel life and permissible rates of fire, said body being capable of generating an average flame temperature of about 2700° K., said module comprising:

a porous self-supporting charge body of interconnected solid compacted spheroidal smokeless propellant grains, each of said grains having an uncompacted propellant grain diameter of at least 100 mils, said body generating a mean gun gas temperature of less than 2000° K. during ignition of said charge module.

2. The module according to claim 1 wherein said charge body has a right circular cylinder shape symmetrical about a central axial bore therethrough.

3. The module according to claim 2 further comprising a solid compacted igniter charge disposed in said bore wherein said igniter charge is an annular right circular cylinder of interconnected compacted spheroidal propellant grains, each of said grains having an uncompacted grain diameter of between about 20 to less than 100 mils.

4. The module according to claim 3 wherein the uncompacted diameter of said igniter charge grains is between about 40 and 70 mils.

5. The module according to claim 1 wherein the uncompacted diameter of said grains is between 120 and 160 mils.

6. The module according to claim 5 wherein said body has a right circular cylinder shape symmetrical about a central axial bore therethrough.

7. The module according to claim 6 further comprising a solid compacted igniter charge disposed in said bore wherein said igniter charge is an annular right circular cylinder of compacted spheroidal propellant grains, each of said grains having an uncompacted grain diameter of between about 20 to less than 100 mils.

8. The module according to claim 7 wherein the uncompacted diameter of said igniter charge grains is between about 40 and 70 mils.

9. The module according to claim further comprising a combustible casing enclosing said body.

10. The module according to claim 1 wherein said casing is a two piece container.

11. A unitary propellant charge module adapted for use as a main charge body in large caliber guns requiring separate ammunition to provide improved barrel life and permissible rates of fire, said body being capable of generating an average flame temperature of about 2700° K., said module comprising:

a combustible container having a generally hollow cylindrical shape;

a generally cylindrical porous, self supporting charge body of interconnected compacted spheroidal smokeless propellant grains disposed within said container, each of said grains having an uncompacted propellant grain diameter of at least 100 mils, said body generating a mean gun gas temperature of less than 2000° K. during ignition of said charge module, said body having a central bore extending therethrough along the longitudinal axis of said body; and at least one porous generally tubular center core igniter body of interconnected compacted spheroidal propellant grains having an unrolled grain size between about 20 to less than 100 mils in diameter disposed within said central bore.

12. The module according to claim 11 further comprising said igniter body having an outer sleeve made of combustible fiber material around said igniter body, said sleeve having a plurality of apertures therethrough.

13. The module according to claim 12 further comprising a plurality of igniter strands disposed within said tubular igniter body.

14. The module according to claim 11 wherein said container is a coating applied to the exterior of said charge.

15. The module according to claim 14 wherein said coating is a polyurethane system.

16. The module according to claim 11 wherein said igniter body has an exterior coating of a moisture proofing material.

17. The module according to claim 11 further comprising at least one igniter ring axially disposed adjacent said igniter body within said bore.

18. The module according to claim 17 further comprising a pair of igniter rings at opposite ends of said central bore.

19. The module according to claim 11 wherein said bore has a constricted middle portion having a generally uniform diameter separating two larger diameter end portions, each of said end portions receiving and retaining a tubular igniter body adjacent said middle portion and an igniter ring adjacent said igniter body.

20. The module according to claim 19 wherein said igniter ring and said igniter body each have an inner diameter approximately matching the diameter of said constricted middle portion.

21. The module according to claim 20 wherein the uncompacted diameter of said charge body grains is between 120 and 160 mils.

22. The module according to claim 21 wherein the uncompacted diameter of said propellant grains in said igniter body is between about 40 and 70 mils.

23. A unitary propellant charge module for use in separate ammunition to provide improved barrel life and permissible rates of fire, said body being capable of generating an average flame temperature of about 2700° K., comprising:

a generally cylindrical charge body of interconnected compacted spheroidal smokeless propellant grains, each of said grains having an uncompacted propellant grain diameter of between about 120 to about 160 mils, said body generating a mean gun gas temperature of less than 2000° K. during ignition of said charge module, said body having a central bore extending therethrough along the longitudinal axis of said body;

at least one generally tubular center core igniter body of interconnected compacted spheroidal smokeless propellant grains having an unrolled grain size between about 40 to 70 mils in diameter disposed within said central bore; and a casing consisting of a moisture proof abrasion protective combustible film on and over said compressed charge body.

24. The module according to claim 23 further comprising at least one igniter ring axially disposed adjacent said igniter body within said bore.

25. The module according to claim 23 further comprising a pair of igniter rings at opposite ends of said central bore.

26. The module according to claim 23 wherein said bore has a constricted middle portion having a generally uniform diameter separating two larger diameter end portions, each of said end portions receiving and retaining a tubular igniter body adjacent said middle portion and an igniter ring adjacent said igniter body.

27. The module according to claim 25 wherein said igniter ring and said igniter body each have an inner diameter approximately matching the diameter of said constricted middle portion.

* * * * *

UNITED STATES PATENT AND TRADEMARK OFFICE

CERTIFICATE OF CORRECTION

PATENT NO. : 5,269,224

DATED : December 14, 1993

INVENTOR(S) : GONZALEZ ET AL

It is certified that error appears in the above-indentified patent and that said Letters Patent is hereby corrected as shown below:

On the title page, Item [19] & [75]: "GONZALES ET AL" should read —GONZALEZ ET AL—

On the title page, Item [75] Inventors: "Antonio Gonzales" should read —Antonio Gonzalez—

On the title page, Between "CASELESS" and "AMMUNITION" replace "UTILIZED" with —UNITIZED—.

Signed and Sealed this

Thirty-first Day of May, 1994

Bruce Lehman

*Attest:*

BRUCE LEHMAN

*Attesting Officer*

*Commissioner of Patents and Trademarks*